US007935026B2

(12) United States Patent
McSorley

(10) Patent No.: US 7,935,026 B2
(45) Date of Patent: May 3, 2011

(54) EXTREMITY THERAPY APPARATUS

(76) Inventor: Tyrone G. McSorley, San Luis Obispo, CA (US)

( * ) Notice: Subject to any disclaimer, the term of this patent is extended or adjusted under 35 U.S.C. 154(b) by 162 days.

(21) Appl. No.: 12/323,377

(22) Filed: Nov. 25, 2008

(65) Prior Publication Data

US 2010/0130330 A1 May 27, 2010

(51) Int. Cl.
*A63B 23/16* (2006.01)

(52) U.S. Cl. ..... 482/48; 482/44

(58) Field of Classification Search ..... 482/44, 482/47–49, 110; 601/40
See application file for complete search history.

(56) References Cited

U.S. PATENT DOCUMENTS 663,486 A * 12/1900 Boren ..... 297/19
1,472,906 A 11/1923 Gorrell
2,739,783 A 3/1956 Penetcost
2,871,915 A 2/1959 Hogan
3,384,332 A 5/1968 Fenner et al.
3,606,316 A 9/1971 Krewer
3,778,052 A 12/1973 Andow et al.
3,782,719 A 1/1974 Kuhlman
3,871,646 A 3/1975 Slack
4,149,713 A 4/1979 McLeod
4,640,268 A 2/1987 Roberts
4,724,827 A 2/1988 Schenck
4,973,050 A 11/1990 Santoro et al.
5,018,725 A 5/1991 Cook
5,102,122 A 4/1992 Piane et al.
5,303,696 A 4/1994 Boice
5,403,253 A 4/1995 Gaylord
5,403,270 A 4/1995 Schipper
5,441,255 A 8/1995 Verbick
5,445,582 A 8/1995 Brown
5,472,407 A 12/1995 Schenck
5,556,359 A 9/1996 Clementi
5,569,138 A 10/1996 Wang et al.
5,626,540 A 5/1997 Hall
5,662,560 A 9/1997 Svendsen et al.
5,667,461 A 9/1997 Hall
5,738,613 A 4/1998 Clayton
5,788,606 A 8/1998 Rich
5,820,577 A 10/1998 Taylor
5,885,190 A 3/1999 Reiter
6,036,622 A 3/2000 Gordon
6,099,438 A 8/2000 Dawson
6,102,836 A 8/2000 Person
6,146,315 A 11/2000 Schonenberger
6,148,580 A 11/2000 Weir
6,165,110 A 12/2000 Gajda (Continued)

OTHER PUBLICATIONS

Sammons Preston Professional Rehab Catalog 2006 pp. 230, 233-237, 245, 263, 266, 270.

(Continued)

*Primary Examiner* — Loan Thanh
*Assistant Examiner* — Shila Abyaneh
(74) *Attorney, Agent, or Firm* — Philip A. Steiner, Esq.

(57) ABSTRACT

Extremity therapy apparatus configured to maintain an extremity in a suitable geometry for performing extremity therapy. The extremity therapy apparatus includes two or more arcuate members which are radially repositionable about a common vertical axis with a support member and/or base member. Each arcuate member is configured to maintain a radial element in a suitable geometry with the extremity for performing the extremity therapy by providing a bias force or movement inhibition in opposition to movement of at least a joint associated with the extremity undergoing the extremity therapy.

20 Claims, 8 Drawing Sheets

U.S. PATENT DOCUMENTS

| | | | | |
|---|---|---|---|---|
| 6,179,751 | B1 | 1/2001 | Clears | |
| 6,213,918 | B1 | 4/2001 | Rogers, Jr. | |
| 6,280,361 | B1 | 8/2001 | Harvey et al. | |
| 6,551,216 | B2 | 4/2003 | Rennex | |
| 6,554,747 | B1 | 4/2003 | Rempe | |
| 6,612,845 | B1 | 9/2003 | Macri et al. | |
| 6,652,426 | B2 | 11/2003 | Carter et al. | |
| 6,685,600 | B1 * | 2/2004 | Ullman | 482/103 |
| 6,705,976 | B1 | 3/2004 | Piane, Jr. | |
| 6,740,051 | B2 | 5/2004 | Hepburn et al. | |
| 6,942,487 | B2 | 9/2005 | Corbalis | |
| 6,986,728 | B2 | 1/2006 | Kasun | |
| 7,048,677 | B2 | 5/2006 | Mackert et al. | |
| 7,081,075 | B2 * | 7/2006 | Sachs | 482/147 |
| 7,104,926 | B2 | 9/2006 | Carlson | |
| 7,128,695 | B2 | 10/2006 | Panatta | |
| 7,160,228 | B2 | 1/2007 | Liu | |
| 7,172,538 | B2 | 2/2007 | Keiser | |
| 7,235,038 | B2 | 6/2007 | Liao | |
| 7,238,116 | B1 | 7/2007 | Sulzener | |
| 7,288,051 | B1 | 10/2007 | Phillips | |
| 7,335,141 | B2 * | 2/2008 | Piane, Jr. | 482/99 |
| 7,553,262 | B2 | 6/2009 | Piane, Jr. | |
| 7,625,320 | B2 | 12/2009 | Wehrell | |
| 7,651,450 | B2 | 1/2010 | Wehrell | |
| 7,666,126 | B2 | 2/2010 | Rempe | |
| 7,758,479 | B2 | 7/2010 | Husted et al. | |
| 2003/0027694 | A1 | 2/2003 | Harrison | |
| 2003/0105416 | A1 | 6/2003 | Hepburn et al. | |
| 2003/0114281 | A1 | 6/2003 | Mackert et al. | |
| 2006/0160677 | A1 | 7/2006 | Piane, Jr. | |
| 2006/0178247 | A1 | 8/2006 | Liu | |
| 2006/0247102 | A1 | 11/2006 | Kupferman | |
| 2007/0129216 | A1 | 6/2007 | Ott et al. | |
| 2008/0020912 | A1 | 1/2008 | Dalebout et al. | |
| 2010/0022368 | A1 * | 1/2010 | Fernandez et al. | 482/140 |
| 2010/0130330 | A1 | 5/2010 | McSorley | |

OTHER PUBLICATIONS

Office action in child case U.S. Appl. No. 12/566,868.
Reply to office in child case U.S. Appl. No. 12/566,868.

* cited by examiner

EXTREMITY THERAPY APPARATUS

CROSS-REFERENCE TO RELATED APPLICATIONS

Not Applicable

RELEVANT INVENTIVE FIELD

The various exemplary embodiments relate generally to a physical therapy apparatus and more specifically to an apparatus for providing physical and/or occupational therapy to an extremity.

BACKGROUND

Extremities, particularly the intricate anatomy of the arm and hand are used extensively in everyday life. As such, hands are the most commonly injured part of the body. The human hand has 27 bones which are specifically driven by muscles and tendons for grasping, holding and/or manipulating physical objects. Injury and/or disease which affects the muscles, tendons and/or bones of the hand can result in disability if effective treatments are not performed in a timely manner. The intricate anatomy of the arm and hand requires very delicate surgery, often with microscopic techniques. However, postoperative recovery necessitates an effective therapy regimen for rehabilitation. Effective therapy requires exercising specific muscles and joints of the affected hand or arm in order to regain or improve functionality and mobility. The types of exercises and number of repetitions to be performed by the patient are usually determined by a hand therapist. Hand therapists are specially trained physical or occupational therapists who specialize in treating injuries and mitigating disease impacts to the hand.

SUMMARY

The various exemplary embodiments disclosed herein address a long felt need in extremity therapy for an apparatus which may be used for providing effective therapy regimens to a patient without requiring a multitude of separate apparatuses, the ability to focus recuperative exercises on specific muscles, joints and/or bones of the hand and/or arm and which provides flexible geometries to effectively and comfortably treat patients as part of the effective therapy regimen. For purposes of this specification, an extremity includes the bones, muscles, tendons and joints of the elbow, forearm, wrist, hand and individual digits.

In an embodiment, an extremity therapy apparatus is configurable for many applications, including but not limited to preventative care, rehabilitation and/or training. For example, in the proper grip of hand tools, athletic equipment simulation, and/or musical instruments. The extremity therapy device may used to provide therapy for one or both extremities, either in a single unit or a pair of side by side units. In certain therapy implementations, the extremity therapy apparatus may be configured to allow improved neuromuscular integration of movement patterns and/or training specificity of each extremity simultaneously.

In an embodiment, the extremity therapy apparatus includes a plurality of arcuate members which are radially repositionable about a common vertical axis with a base member. Each arcuate member is configured to maintain a radial element in a suitable geometry with an extremity for performing extremity therapy by providing a bias force or movement inhibition in opposition to movement of a joint associated with the extremity undergoing the extremity therapy. Generally, the suitable geometry provides the bias force and/or movement inhibition approximately at a perpendicular angle to a joint of the extremity.

In an embodiment, a support member is provided with a grip member which allows the patient's hand to comfortably grip the support member in either a vertical or horizontal plane. In an embodiment, the diameter of the grip member may be varied to allow for various levels of disability of the hand. Variability in the diameter of the grip member also provides for greater flexibility in focusing the bias force or movement inhibition on a particular muscle, tendon, bone and/or joint.

In an embodiment, a base member is provided which allows the support member to be repositioned along the base member's longitudinal axis. A separate longitudinal member is provided which axially maintains the arcuate members in a common vertical plane with the base member. The longitudinal member is maintained in the common vertical plane with the support member by a column member. The column member is coupled at one end of the base member and is configured to axially maintain the longitudinal member in a parallel spaced relationship with the base member.

In an embodiment, the support member is configured as platform for supporting the extremity undergoing therapy at various angles relative to a horizontal plane. The platform is coupled to a locking pivoting joint which maintains the extremity undergoing therapy at the suitable geometry.

In an embodiment, the grip member is repositionable in various locations about the top surface of the platform. In an embodiment, connectors are used to couple one end of the radial elements with the arcuate members. One or more extremity slings are used to couple the opposite end of the radial element to the extremity.

In an embodiment, the platform is replaced with a piece of athletic equipment, musical instrument or hand tool for training and/or therapeutic purposes.

BRIEF DESCRIPTION OF DRAWINGS

The features and advantages of the various exemplary embodiments will become apparent from the following detailed description when considered in conjunction with the accompanying drawings. Where possible, the same reference numerals and characters are used to denote like features, elements, components or portions of the inventive embodiments. It is intended that changes and modifications can be made to the described exemplary embodiments without departing from the true scope and spirit of the inventive embodiments as is defined by the claims.

DETAILED DESCRIPTION

Figure 1:
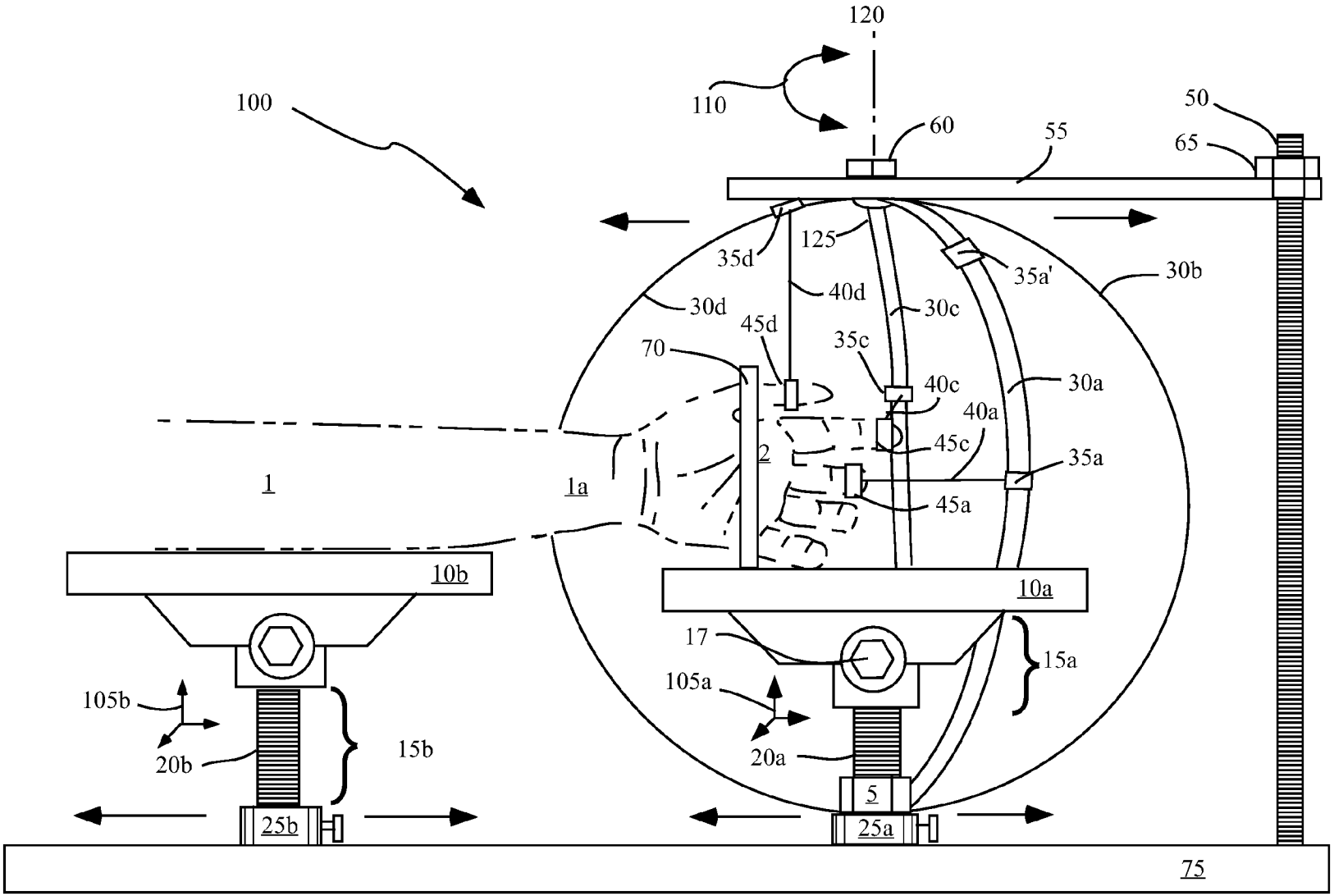
FIG. 1—depicts a side view of an extremity therapy apparatus in accordance with an exemplary embodiment.
Figure 6:
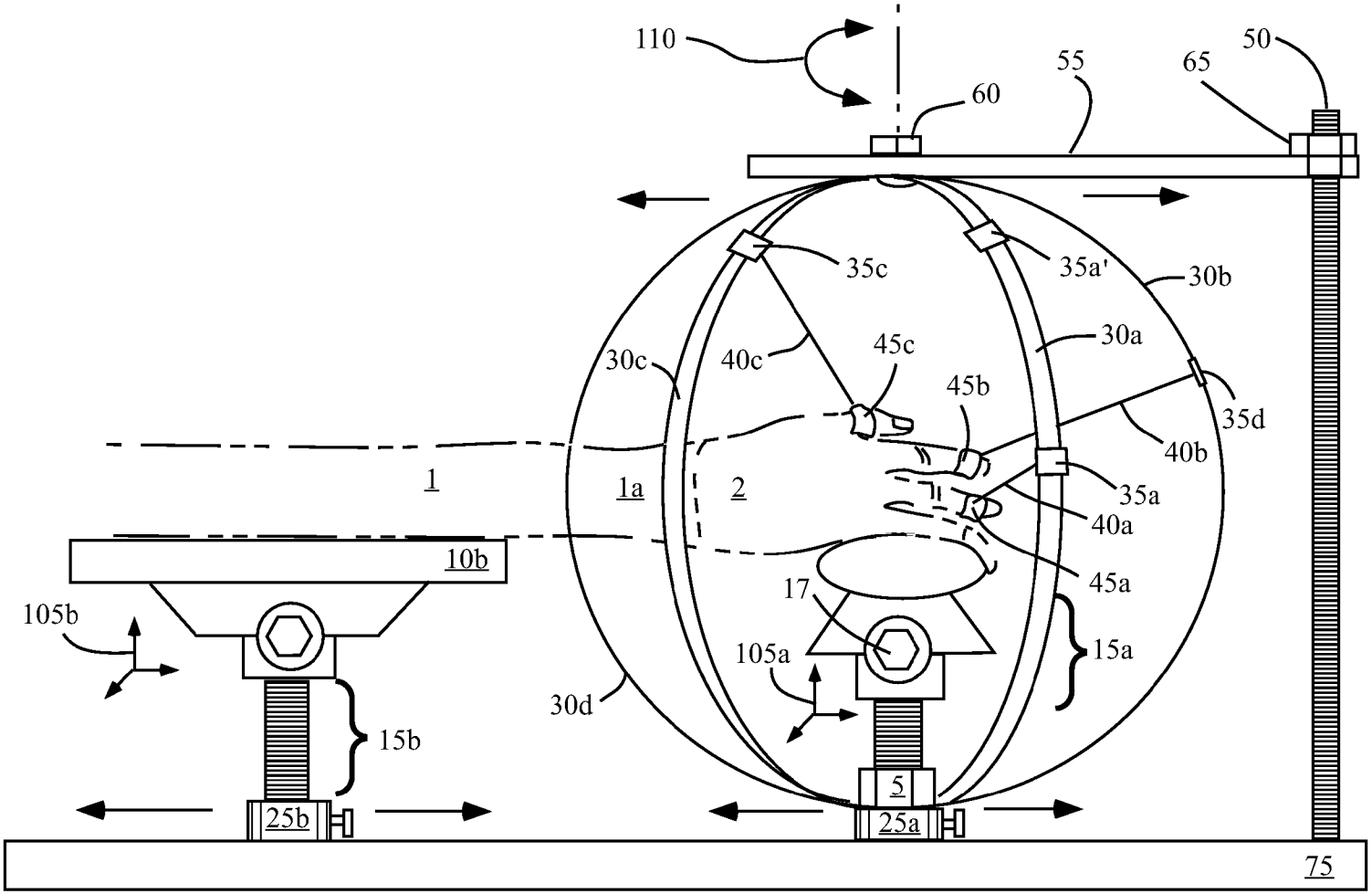
FIG. 6—depicts another side view of an extremity therapy apparatus in accordance with an exemplary embodiment.

Effective treatment of injuries and/or diseases of the extremities require placing the extremity in specific geometries in order to properly focus the use of specific muscles, tendons, joints and/or bones. Analogously, physical training of grips of athletic equipment, musical instruments or hand tools used in a trade or profession necessitates specific geometries in order to maximize neuromuscular training, sometimes referred to as "muscle memory." The various exemplary embodiments described below address a long felt need in sports medicine, physical and/or occupational therapy to provide effective treatments by specifically isolating muscles and/or joints of the hand and arm to improve or regain a patient's mobility or improve the patient's training performance. Referring to FIG. 1, a side view of an extremity therapy apparatus 100 in accordance with an exemplary embodiment is depicted. In an embodiment, the extremity therapy apparatus 100 is provided with a support member 10*a* configured to maintain an extremity 1 in a suitable geometry for performing extremity therapy, typically to a wrist 1*a*, hand 2 and/or digit(s) of the hand 2. In an embodiment, the support member 10*a* is configured as a platform in which the extremity, typically a hand 2, is rested upon. Therapy may be provided with the palm of the hand 2 perpendicular with the platform as shown in FIG. 1, with the palm in parallel (either palm up or palm down) to the platform as shown in FIG. 6, or with the hand 2 grasping a particular object as shown in FIG. 7.

In an embodiment, the support member 10*a* is axially coupled to a multi-axis joint 15*a* which allows adjustment of the support member 10*a* so that a patient's extremity is in the suitable geometry 105*a* for performing the extremity therapy. The multi-axis joint 15*a* allows angular adjustment of the support member 10*a*. The multi-axis joint 15*a* may be locked into the suitable geometry 105*a* for a patient to exercise a particular digit, muscle or joint of the hand 2 and/or wrist by manipulation of retaining mechanism 17. In an embodiment, the multi-axis joint 15*a* is provided by a ball joint or a universal type joint. The height of the support member 10*a* may be varied to accommodate various therapy needs. For example, a patient whose arm is in a cast may be limited to a particular geometry in order to comfortably place their hand 2 onto the support member 10*a*. In another example, a child, having shorter limbs may need to have the support member 10*a* raised to obtain the suitable geometry 105*a*.

Figure 7:
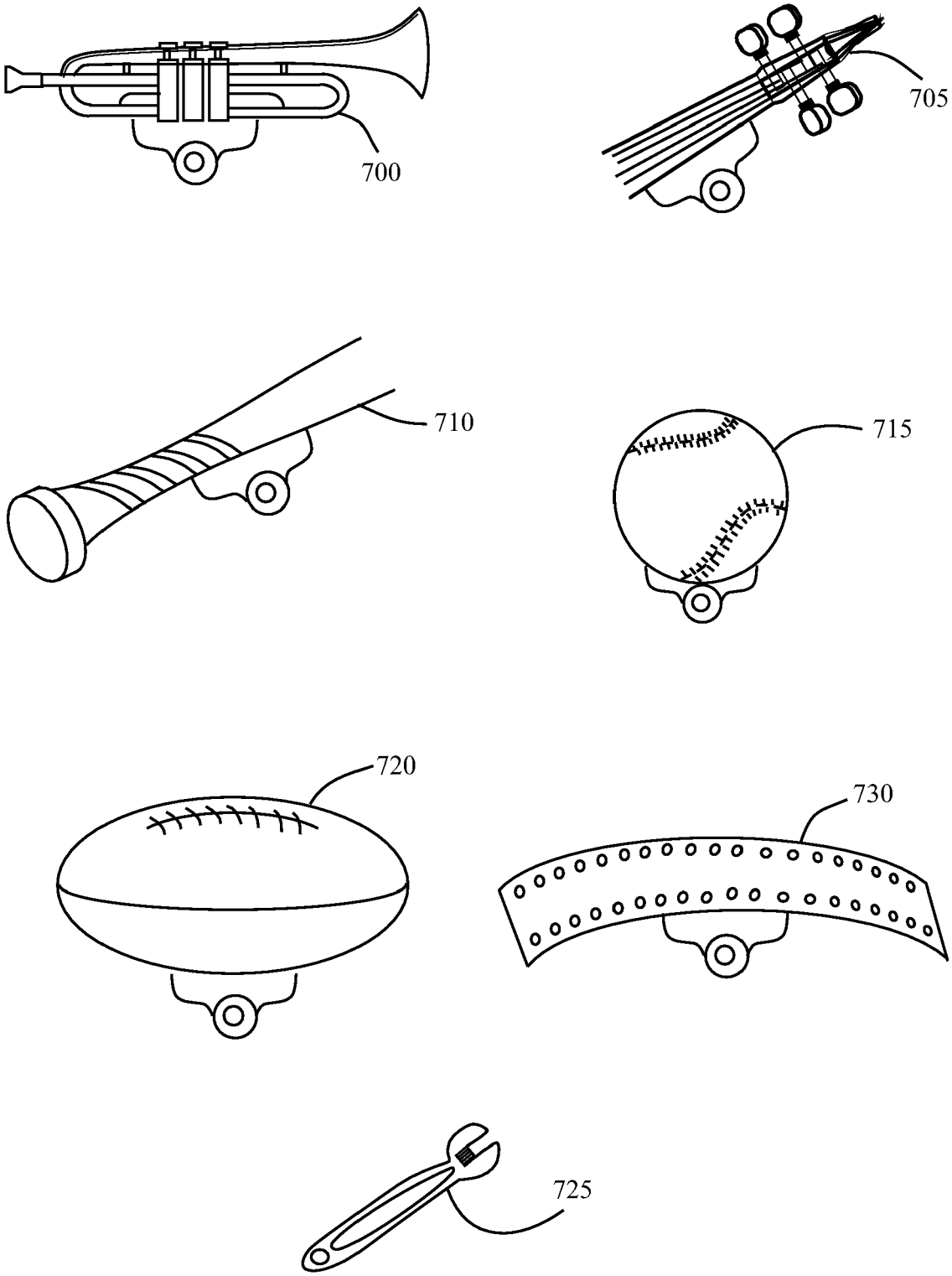
FIG. 7—depicts another side view of various support members in accordance with an exemplary embodiment.

In an embodiment, the planar support member 10*a* may be replaced with another support member configured as athletic equipment, musical instruments or hand tools as is shown in FIG. 7. In this embodiment, each of the alternate support members 700, 705, 710, 715, 720, 725, 730 may be used to specifically improve a grip for sports training purposes or specifically target therapy on an injured muscle, joint, bone and/or tendon. Replacement of the planar support member 10*a* shown in FIG. 1 with one of the alternate support members 700, 705, 710, 715, 720, 725, 730 may be accomplished by manipulation of retaining mechanism 17 which releases the currently installed support member 10*a* from the multi-axis joint 15*a*.

In an embodiment, the height of the support member 10*a* may be adjusted using a height adjustment member 20*b* as shown in FIG. 1. For exemplary purposes only, the height adjustment member 20*b* is shown as a type of jack screw. Alternately, the height of the support member 10*a* may be adjusted using a pneumatic lift arrangement. In another embodiment, the height of the support member 10*a* may be adjusted using a simple clamping mechanism, similar to that used in maintaining the height of a bicycle seat. One skilled in the art will appreciate there are many ways of adjusting the height of the support member 10*a* known in the relevant art.

The extremity therapy apparatus 100 includes two or more arcuate members 30*a*, 30*b*, 30*c*, 30*d* which are radially repositionable 110 about a common vertical axis 120 with the base member 75. Each arcuate member 30*a*, 30*b*, 30*c*, 30*d* is configured to maintain one or more radial elements 40*a*, 40*c*, 40*d* in the suitable geometry 105*a* with the extremity for performing the extremity therapy. The radial elements 40*a*, 40*c*, 40*d* may be configured to either inhibit movement in a particular range of motion or to provide a bias force in opposition to movement of a joint, muscle, bone and/or tendon associated with the extremity 1 undergoing the extremity therapy. Generally, when the extremity therapy apparatus 100 is properly configured with the suitable geometry 105*a*, the bias force or movement inhibition is applied approximately at a perpendicular angle to a joint of the hand 2 or arm.

In an embodiment, the arcuate members 30*a*, 30*b*, 30*c*, 30*d* are concentrically arranged about the common vertical axis 120, so that each arcuate member 30*a*, 30*b*, 30*c*, 30*d* may be positioned 110 into a common alignment which reduces the cross section of the extremity therapy apparatus 100 for storage. The arcuate members 30*a*, 30*b*, 30*c*, 30*d* are shown as concentric bands in FIG. 1 for illustrative purposes only. In an embodiment, a base member 75 is provided which allows the support member 10*a* to be repositioned using a slide member 25*a* along the base member's longitudinal axis. A locking member 5 is used to secure the arcuate members 30*a*, 30*b*, 30*c*, 30*d* against the top of the slide member 25*a*.

A cantilevered longitudinal member 55 is provided which axially maintains the arcuate members 30*a*, 30*b*, 30*c*, 30*d* in the common vertical plane 120 with the support member 10*a*. The longitudinal member 55 is maintained in the common vertical plane 120 with the support member 10*a* by a column member 50. The column member 50 is coupled at one end of the base member 75 and is configured to axially maintain the longitudinal member 55 in a parallel spaced relationship with the base member 75.

In an embodiment, the height of the longitudinal member 55 above the support member 10*a* may be adjusted by turning a retaining nut 65. The column member 50 is shown as an all-thread for illustrative purposes only. In embodiments where the height of the longitudinal member 55 is made adjustable, the arcuate members 30*a*, 30*b*, 30*c*, 30*d* are constructed from a suitable flexible materials, which allows compression and expansion without permanent deformation of the arcuate members 30*a*, 30*b*, 30*c*, 30*d*.

The arcuate members 30*a*, 30*b*, 30*c*, 30*d* may be coupled to the longitudinal member 55 by a nut 60 and machine bolt 125. In an embodiment, the nut 60 and machine bolt 125 are repositionably maintained by the longitudinal member 55 such that the arcuate members 30*a*, 30*b*, 30*c*, 30*d* are generally maintained in the common vertical plane 120 with the support member 10*a* and/or base member 75 during extremity therapy. Tightening of the nut 60 maintains the arcuate members 30*a*, 30*b*, 30*c*, 30*d* in the suitable geometry 105*a* for extremity therapy. In an embodiment, the nut 60 and machine bolt 125 may be replaced by a rivet or another type of fastener (not shown).

At the opposite end(s) of the arcuate members 30*a*, 30*b*, 30*c*, 30*d*, from the machine nut 60 and machine bolt 125, rings (not shown) dimensioned slightly larger than the cross sectional diameter of the height adjustment member 20*b* are provided which allows the arcuate members 30*a*, 30*b*, 30*c*, 30*d* to axially rotate 110 around the common vertical plane 120. A locking nut 5 is provided on the height adjustment member 20*b* to maintain the arcuate members 30*a*, 30*b*, 30*c*, 30*d* in the suitable geometry 105*a* for extremity therapy in cooperation with the nut 60 and machine bolt 125.

The radial elements 40*a*, 40*c*, 40*d* are maintained on the arcuate members 30*a*, 30*b*, 30*c*, 30*d* at one end with one or more connectors 35*a*, 35*c*, 35*d*. The connectors are configured to repositionably clamp onto the arcuate members 30*a*, 30*b*, 30*c*, 30*d* and maintain the suitable geometry 105*a* during extremity therapy. Alternately, the arcuate members 30*a*, 30*b*, 30*c*, 30*d* may be configured using rods constructed of suitable materials. In an embodiment, the arcuate members 30*a*, 30*b*, 30*c*, 30*d* include longitudinal slots 130 (FIG. 1A) for longitudinally positioning of the connectors 35*a*, 35*c*, 35*d* on the arcuate members 30*a*, 30*b*, 30*c*, 30*d* to obtain the suitable geometry 105*a* for extremity therapy.

In an embodiment, when extremity therapy is to be performed on one or more digits, extremity slings 45A, 45C, 45D are used to connect with the opposite end(s) of radial elements 40*a*, 40*c*, 40*d*. The extremity slings 45A, 45C, 45D may be coupled to the radial elements 40*a*, 40*c*, 40*d* using common fasteners, tied with cord or sewn directly onto the radial elements 40*a*, 40*c*, 40*d*.

In an embodiment, when used to provide bias force, the radial elements 40*a*, 40*c*, 40*d* are constructed from elastomeric materials such as synthetic rubber, latex, natural rubber and like polymers. The lengths of the radial elements 40*a*, 40*c*, 40*d* and amount of tension to be provided during extremity therapy are selected by the hand therapist. Thus, various lengths, and/or tensions of the radial elements 40*a*, 40*c*, 40*d* are used in the course of treatment of the patient. By way of example and not limitation, various sizes of latex tubing, rubber bands and like materials may be used to customize the amount of tension generated by the radial elements 40*a*, 40*c*, 40*d* during extremity therapy.

In an embodiment, when the radial elements 40*a*, 40*c*, 40*d* are used to provide movement inhibition, the radial elements 40*a*, 40*c*, 40*d* are constructed from rigid or semi-rigid materials such as polyvinyl chloride (PVC), acrylonitrile butadiene styrene (ABS) or any other suitable material configured in a rod shape and longitudinally dimensioned to span the distance between an arcuate member 30*a*, 30*b*, 30*c*, 30*d* and an extremity of the hand 2, wrist 1*a*, or forearm 1.

In an embodiment, a second support member 10*b* is provided and longitudinally aligned with the support member 10*a*. The second support member 10*b* includes an equivalent multi-axis joint 15*b* and height adjustment member 20*b* (e.g., jack screw) as the support member 10*a*. The second support member 10*b* may be repositioned with a slide member 25*b* along the base member's longitudinal axis as is needed to adjust to a particular patient's needs and the suitable geometry 105*b* for performing the extremity therapy. In general, the second support member 10*b* is used to support the forearm portion of the patient's extremities 105.

In an embodiment, an elongated grip member 70 provides the patient undergoing extremity therapy with a leverage point or used for movement inhibition of a particular muscle, joint, tendon and/or bone. When configured as a movement inhibition member, the elongated grip member 70 may be interchangeably referred to as a blocking member.

Figure 2:
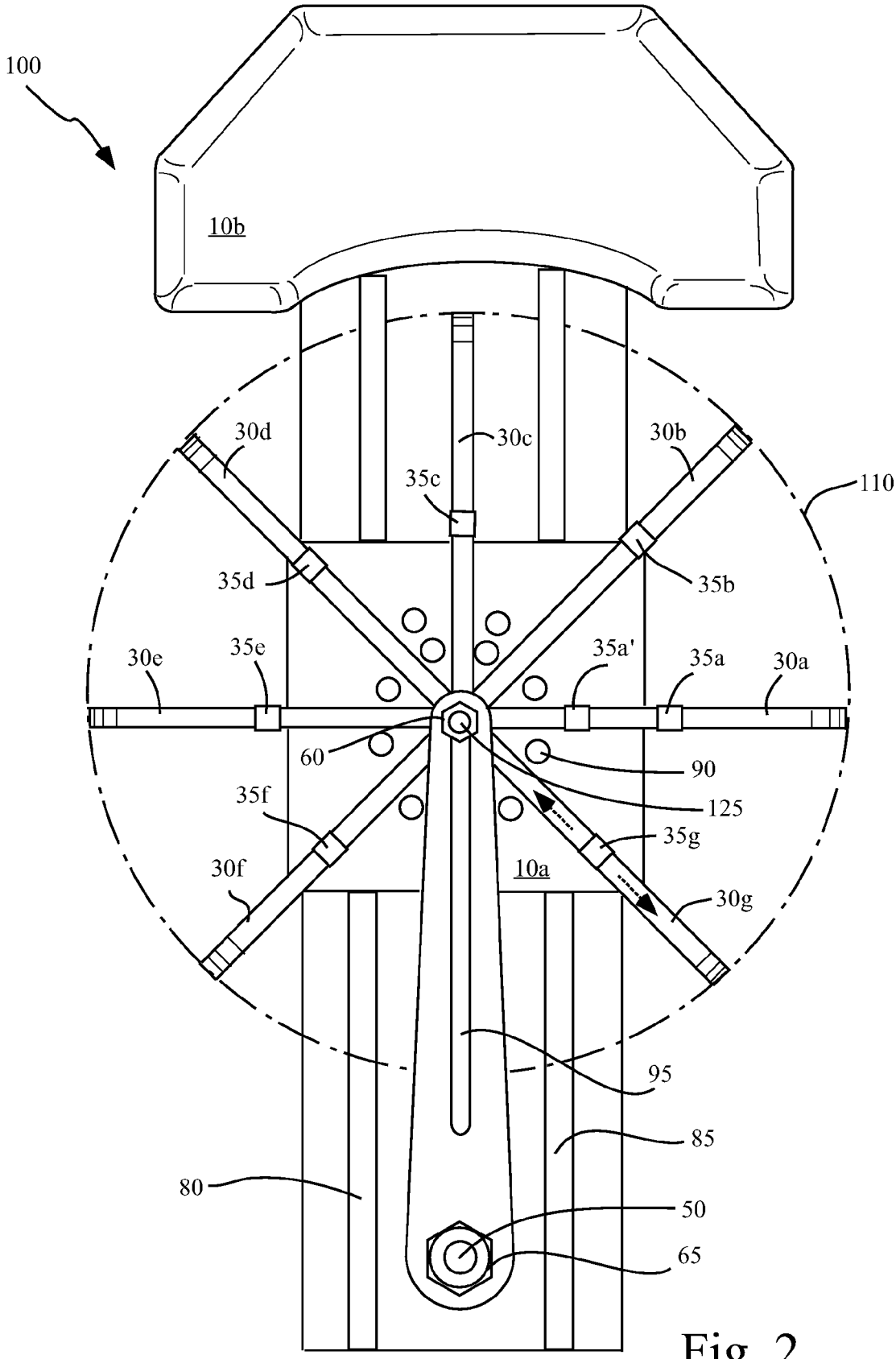
FIG. 2—depicts a top view of an extremity therapy apparatus in accordance with an exemplary embodiment.

As such, the elongated grip member 70 may then be used to focus exercises on a particular muscle, tendon, bone and/or joint. The grip member 70 may be repositioned about the top surface of the support member 10*a* by inserting an end of the grip member 70 into one of the grip positioning points 90 (FIG. 2). In an embodiment, the grip member 70 is mounted perpendicularly to the top surface of the support member 10*a*. The grip member 70 may also be sized in various diameters to accommodate differences in sizes of hands and/or treatment regimens. In another embodiment, the grip member 70 may be provided with an ovoid shape for improved grasping by a hand 2; by way of example and not limitation, as a joystick (not shown), as athletic equipment 700, 705, musical instruments 710, 715, hand tool 725 or hand therapy unit 730 as is shown in FIG. 7 In another embodiment, the grip member 70 may be provided with a multi-axis joint at its base (not shown) to allow for customized extremity therapy of a particular digit, joint, tendon, bone and/or muscle.

In an embodiment, the grip member 70 is maintained in one of the grip positioning points 90 (FIG. 2) by inserting an end of the grip member 70 into one of the grip positioning points 90 (FIG. 2) in a dowel and socket arrangement (not shown). In another embodiment, the grip member 70 includes a threaded end which forms a bolt for threading into one of the grip positioning points 90 (FIG. 2). One skilled in the art will appreciate that there are numerous ways to repositionably maintain the grip member 70 within a grip positioning point 90 (FIG. 2). The latter and former arrangements are intended as examples only.

Figure 1A:
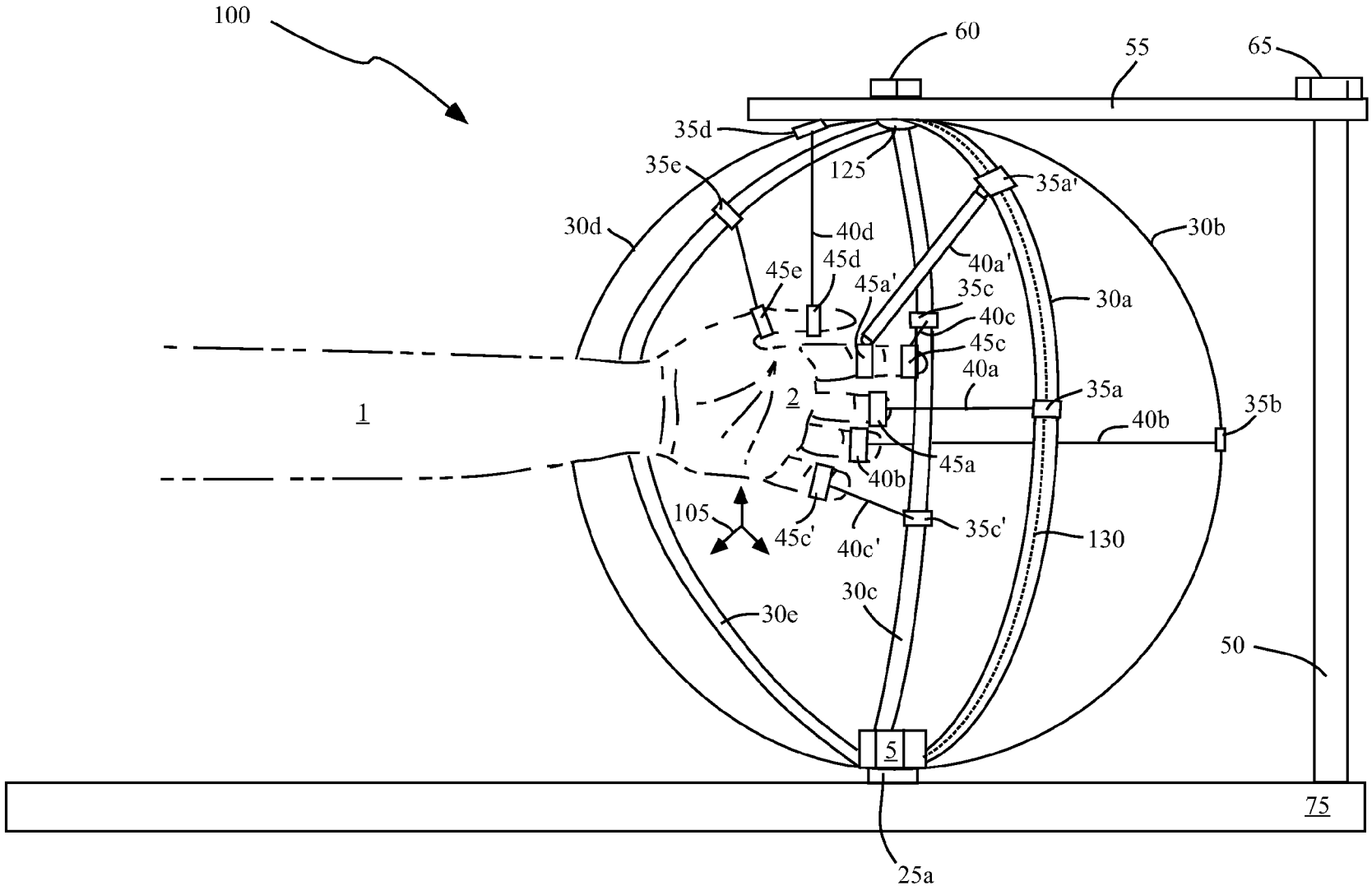
FIG. 1A—depicts another side view of an extremity therapy apparatus in accordance with an exemplary embodiment.

Referring to FIG. 1A, another side view of an extremity therapy apparatus 100 is depicted in accordance with an exemplary embodiment. In an embodiment, the support members 10*a*, 10*b*, multi-axis joints 15*a*, 15*b* and height adjustment members 20*a*, 20*b* are removed from the base member 75. In this embodiment, the extremity 1 is supported by the radial elements 40*a*, 40*a'*, 40*b*, 40*c*, 40*c'*, 40*d*, 40*e*, extremity slings 45A, 45A', 45B, 45C, 45C', 45D, 45E, arcuate members 30*a*, 30*b*, 30*c*, 30*d*, 30*e* and the patient's own muscles. In an embodiment, each of the arcuate members 30*a*, 30*b*, 30*c*, 30*d*, 30*e* include a longitudinal slot 130 which is used for positioning of the connectors 35*a*, 35*a'*, 35*b*, 35*c*, 35*c'*, 35*d*, 35*e* such that the extremity 1 is positioned in the suitable geometry 105*a* for receiving extremity therapy.

Referring to FIG. 2, a top view of an extremity therapy apparatus 100 in accordance with an exemplary embodiment is depicted. In an embodiment, the extremity therapy apparatus 100 is provided with one or more rails 80, 85 in which the support member 10*a* and second support member 10*b* are slidably engaged. The rails 80, 85 allow for repositioning of the support member 10*a* and/or the second support member 10*b* about the longitudinal axis of the base member 75 for accommodating different extremity therapies and patient needs. As discussed above, one or more arcuate members 30*a*, 30*b*, 30*c*, 30*d*, 30*e*, 30*f*, 30*g* are aligned along the common vertical plane 120 (FIG. 1) with the support member 10*a* and/or base member 75. Each of the arcuate members 30*a*, 30*b*, 30*c*, 30*d*, 30*e*, 30*f*, 30*g* may be rotated about the common vertical plane 120 (FIG. 1) with the nut 60 and machine bolt 125 and height adjustment member 20*b* (FIG. 1) The number of arcuate members 30*a*, 30*b*, 30*c*, 30*d*, 30*e*, 30*f*, 30*g* used to provide extremity therapy may be varied to accommodate a particular treatment regimen.

In an embodiment, the longitudinal member 55 includes an elongated aperture 95 which allows the nut 60 and machine bolt 125 to be repositioned along the long axis of the longitudinal member 55. Repositioning of the nut 60 and machine bolt 125 moves the common vertical plane 120 (FIG. 1) toward or away from the column member 50. Once repositioned, the nut 60 and machine bolt 125 may be locked into the new position. By selectively repositioning the support member 10*a* and/or the nut 60 and machine bolt 125, the shape of the arcuate members 30*a*, 30*b*, 30*c*, 30*d*, 30*e*, 30*f*, 30*g* may be changed to provide the particular suitable geometry 105*a* (FIG. 1) for performing the extremity therapy.

In an embodiment, the connectors 35*a*, 35*b*, 35*c*, 35*d*, 35*e*, 35*f*, 35*g* may be repositioned about the long axis of the arcuate members 30*a*, 30*b*, 30*c*, 30*d*, 30*e*, 30*f*, 30*g*. In an embodiment, one or more connectors 35*a*, 35*a*' may be coupled to a particular arcuate member 30*a*. In an embodiment, the connectors 35*a*, 35*a'*, 35*b*, 35*c*, 35*d*, 35*e*, 35*f*, 35*g* may be repositioned from one arcuate member to another arcuate member as is needed to provide a particular extremity therapy.

As previously discussed, the height of the longitudinal member 55 may be adjusted by tightening or loosening the locking nut 65 associated with the column member 50. In an embodiment, compression of the arcuate members 30*a*, 30*b*, 30*c*, 30*d*, 30*e*, 30*f*, 30*g* returns a bias force against the longitudinal member 55 which allows the longitudinal member 55 to float about the column 55. As previously discussed, the support member 10*a* includes one or more grip positioning points 90 which couple with the vertically oriented grip member 70 shown in FIG. 1.

Figure 3:
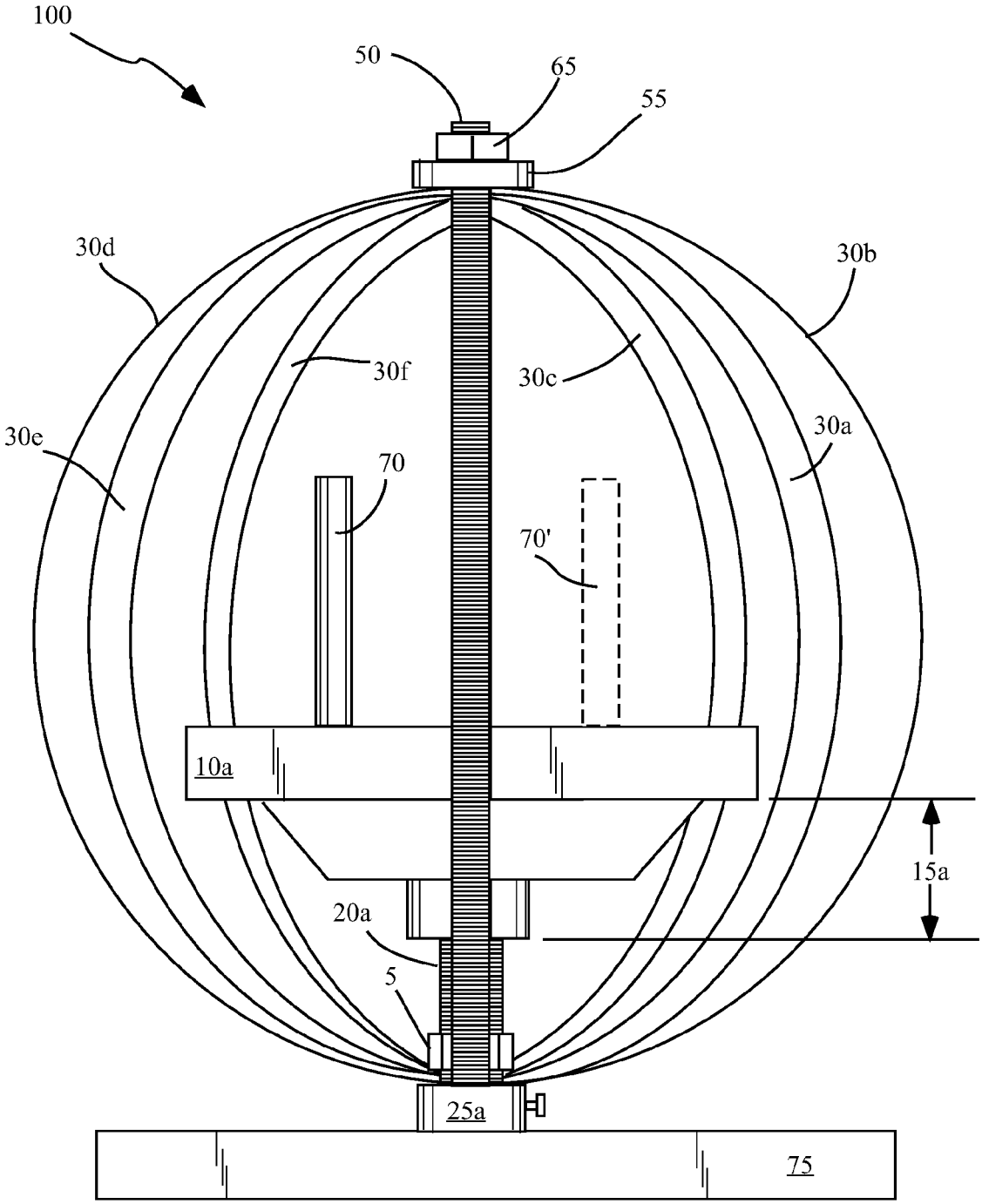
FIG. 3—depicts an end view of an extremity therapy apparatus in accordance with an exemplary embodiment.

Referring to FIG. 3, an end view of an extremity therapy apparatus 100 in accordance with an exemplary embodiment is depicted. In an embodiment, the column member 50 is shown as perpendicularly coupled at an end of the base member 75. The multi-axis joint 15*a* is shown longitudinally coupled to the height adjustment member 20*a*. A locking member 5 is shown at the lower ends of the arcuate members 30*a*, 30*b*, 30*c*, 30*d*, 30*e*, 30*f*. As previously discussed, the locking member 5 is used to maintain the arcuate members 30*a*, 30*b*, 30*c*, 30*d*, 30*e*, 30*f* in a particular suitable geometry 105*a* against the top of the slide member 25*a* in cooperation with lock nut 65.

An end view of the longitudinal member 55 is shown with the locking nut 65 installed on the column member 50. The support member 10*a* is shown as a platform with a grip member 70 installed in a position disposed away from the lateral centerline of the platform. An alternate and/or additional grip member 70' may be disposed in a position on an opposite lateral side of the platform.

Figure 4:
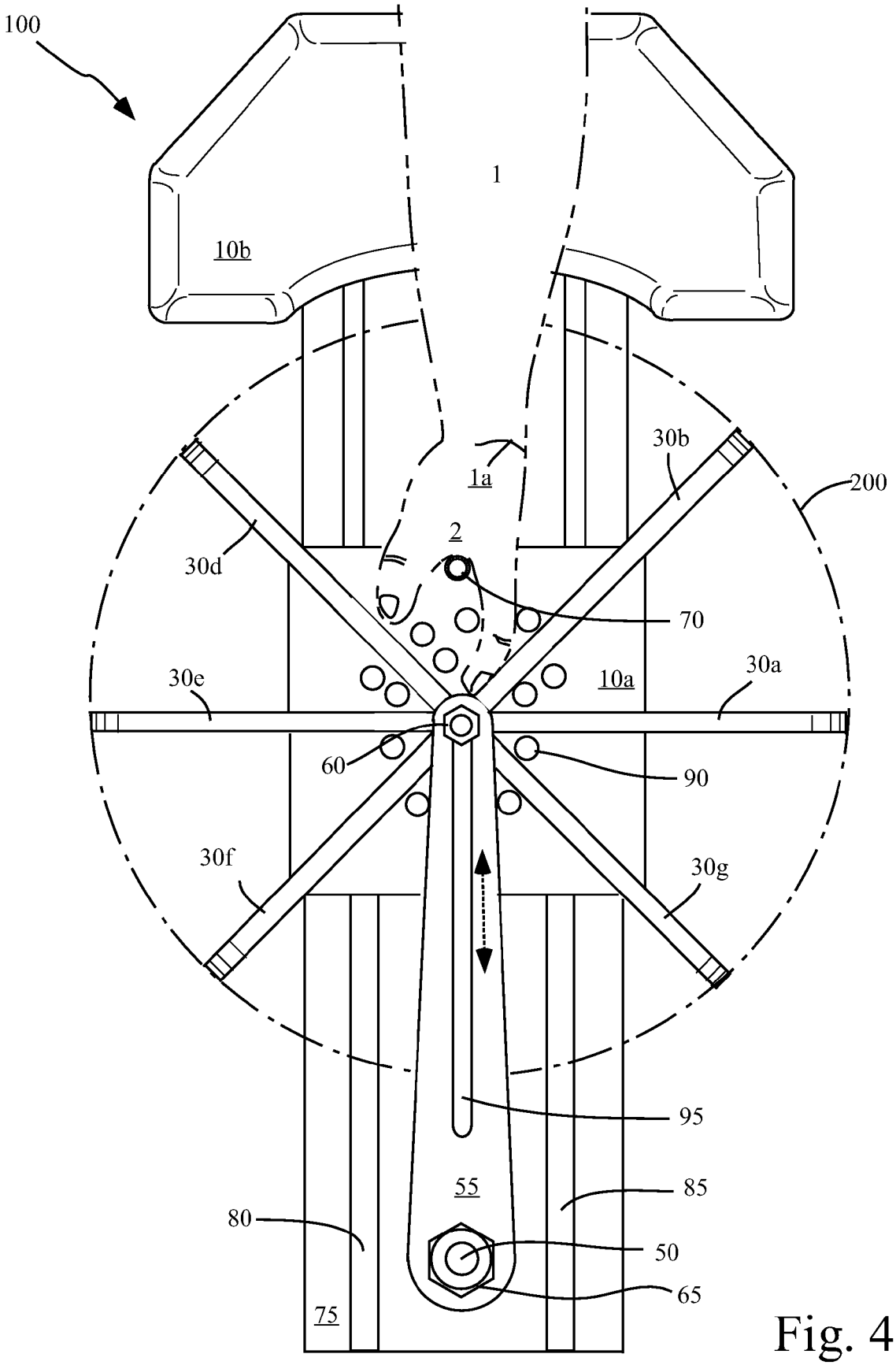
FIG. 4—depicts another top view of an extremity therapy apparatus in accordance with an exemplary embodiment.

Referring to FIG. 4, a top view of an extremity therapy apparatus 100 in accordance with an exemplary embodiment is depicted. In an embodiment, an extremity 1 is shown with a hand 2 disposed against a grip member 70 and placed upon the support member 10*a*. The forearm is shown resting on the second support member 10*b*. In an embodiment, once the extremity has been placed in a comfortable position for the patient, the arcuate members 30*a*, 30*b*, 30*d*, 30*e*, 30*f*, 30*g* are moved into a position to allow placement of connectors 35*a*, 35*a'*, 35*b*, 35*c*, 35*d*, 35*e*, 35*f*, 35*g* to be clamped to the arcuate members 30*a*, 30*b*, 30*c*, 30*d*, 30*e* followed by installation of the radial elements 40*a*, 40*c*, 40*d* as shown in FIGS. 1, 1A and 6. The order of installation and/or positioning may be reversed based on the preference of the hand therapist.

Figure 5:
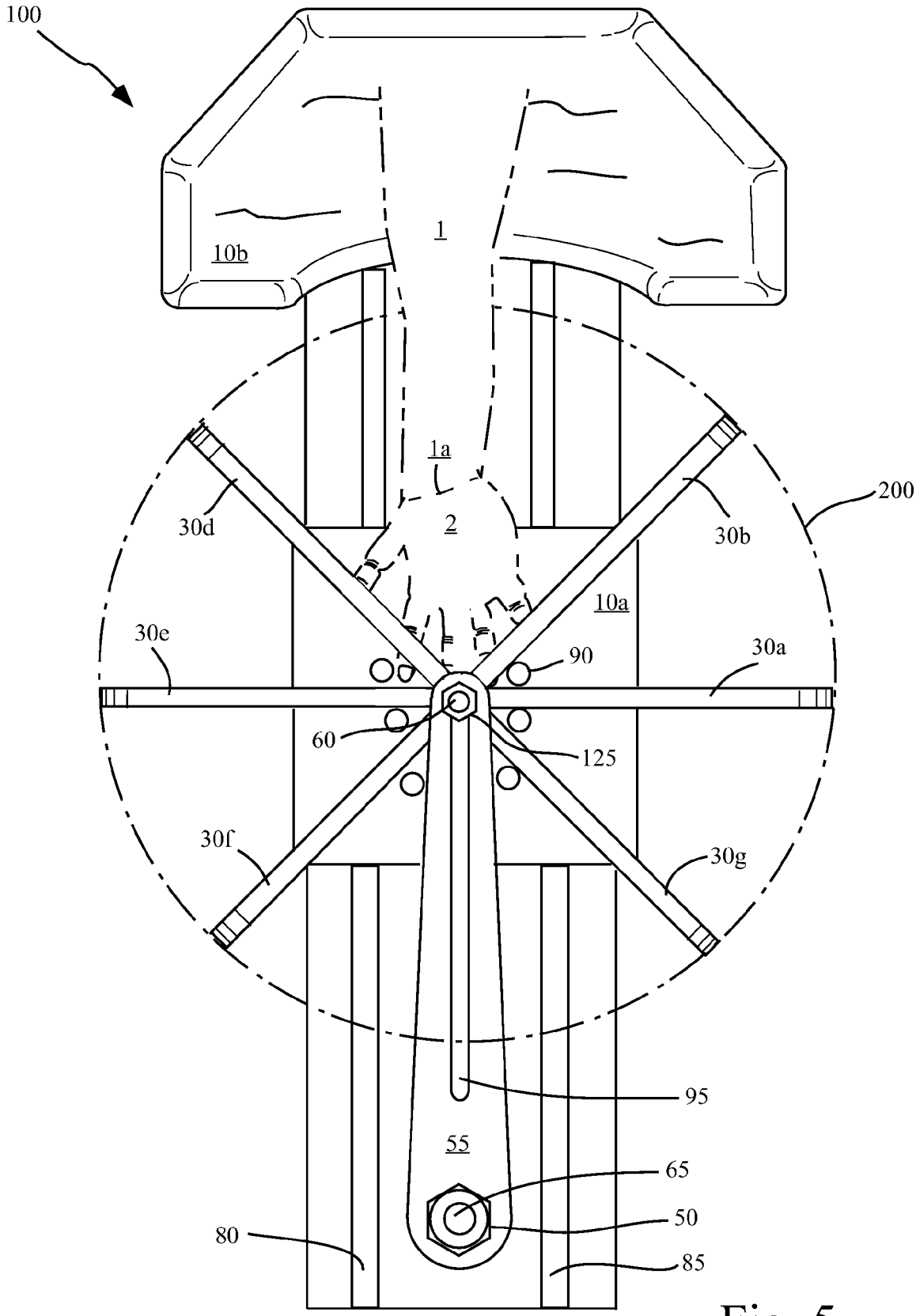
FIG. 5—depicts another top view of an extremity therapy apparatus in accordance with an exemplary embodiment.

Referring to FIG. 5, another top view of an extremity therapy apparatus 100 in accordance with an exemplary embodiment is depicted. In an embodiment, an extremity 1 is shown with a hand 2 disposed in a palm down configuration upon the support member 10*a*. The forearm is shown resting on the second support member 10*b*. In an embodiment, once the extremity has been placed in a comfortable position for the patient, the arcuate members 30*a*, 30*b*, 30*d*, 30*e*, 30*f*, 30*g* are moved into a position to allow placement of connectors 35*a*, 35*a'*, 35*b*, 35*c*, 35*d*, 35*e*, 35*f*, 35*g* to be clamped to the arcuate members 30*a*, 30*b*, 30*d*, 30*e*, 30*f*, 30*g* followed by installation of the radial elements 40*a*, 40*c*, 40*d* as shown in FIGS. 1, 1A and 6.

Referring to FIG. 6, another side view of an extremity therapy apparatus in accordance with an exemplary embodiment is depicted. In an embodiment, the support member 10*a* is provided with an ovoid shape which allows the patient's hand 2 to comfortably rest upon the support member 10*a*. In an exemplary embodiment, the dimensions of the ovoid shaped support member 10*a* may be varied to allow for different sized hands and/or different therapy regimens to be performed.

The construction materials for the various components of the extremity therapy apparatus 100 are not critical. For example, base member 75 and the platform portion of support members 10*a*, 10*b* may be constructed from wood, wood composite or a high impact polymer, as examples PVC or ABS plastic. The components during usage, are under dynamic load, for example the arcuate members 30*a*, 30*b*, 30*d*, 30*e*, 30*f*, 30*g*, (FIG. 2) longitudinal member 55 (FIG. 1), column member 50 (FIG. 1) and height adjustment members 20*a*, 20*b* (FIG. 1), slide members 25*a*, 25*b* (FIG. 1), multi-axis joints 15*a*, 15*b* (FIG. 1), nut 60 and machine bolt 125 (FIG. 1), retaining nut 65 (FIG. 1) connectors and rails 80, 85 (FIG. 5) are envisioned to be constructed from a suitable metal, such as iron, steel or aluminum. Alternatively, some or all of the above listed components 35*a*, 35*a'*, 35*b*, 35*c*, 35*d*, 35*e*, 35*f*, 35*g* (FIG. 2) may be constructed from a suitable high strength polymer. As previously discussed, the radial elements 40*a*, 40*c*, 40*d* (FIG. 1) when used to provide a bias force are constructed from elastomeric materials such as synthetic rubber, latex, natural rubber and like polymers.

The extremity slings 45*a*, 45*c*, 45*d* (FIG. 1) are typically constructed from foam padded cloth and are commercially available from medical supply houses. In embodiments, where the radial elements 40*a*, 40*c*, 40*d* (FIG. 1) are used to provide movement inhibition, the radial elements 40*a*, 40*c*, 40*d* (FIG. 1) are constructed from rigid or semi-rigid materials such as polyvinyl chloride (PVC), acrylonitrile butadiene styrene (ABS) or any other suitable material configured in a rod shape and longitudinally dimensioned to span the distance between an arcuate member 30*a*, 30*b*, 30*c*, 30*d* (FIG. 1) and an extremity of the hand 2, wrist 1*a*, or forearm 1.

Depending on what portion of the extremity 1 is to receive therapy, a selection is made by the therapist as to the proper orientation and support member 10*a* to be used. For example, referring back to FIG. 6, the ovoid shaped support member 10*a* is configured to treat a patient for improving abduction and adduction of the digits. In this example, the therapist selects radial elements 40*a*, 40*b*, 40*c* which will exercise the abductor and adductor muscles of the fingers sufficiently to treat a disability. The amount of bias or block force generated by each of the radial elements 40*a*, 40*b*, 40*c* may be different depending on the level of disability of a particular digit.

Once the proper radial elements 40*a*, 40*b*, 40*c* have been selected, and where necessary cut to size, the therapist next positions the needed arcuate members 30*a*, 30*b*, 30*c* into the suitable geometry 105*a*. As previously discussed, the suitable geometry 105*a* attempts to align the bias forces generated by the radial elements 40*a*, 40*b*, 40*c* approximately perpendicular to a joint moved by a particular muscle. Once the arcuate members 30*a*, 30*b*, 30*c* are positioned into the suitable geometry 105*a*, the lock nut 60 and locking member 5 are tightened to prevent movement. Other geometry adjustments may be made to the height of the support members 10*a*, 10*b* and/or position along the long axis of the base member 75.

The therapist then places the extremity slings 45*a*, 45*b*, 45*c* on the digits to receive the therapy and attaches the radial elements 40*a*, 40*c*, 40*d* to the extremity slings 45*a*, 45*b*, 45*c*. The connectors 35*a*, 35*b*, 35*c* are then clamped onto the arcuate members 30*a*, 30*b*, 30*c* in order to obtain the suitable geometry 105*a* for providing the therapy. The he radial elements 40*a*, 40*c*, 40*d* are then attached to the connectors 35*a*, 35*b*, 35*c*. Minor adjustments may be made to the positions of the arcuate members 30*a*, 30*b*, 30*c* and/or connectors to account for the tension applied to the digits. The patient then begins exercising the digits in which tension is applied. Other extremity therapies are conducted in like fashion.

Depending on the portion(s) of the extremity that a patient is to receive therapy, an almost unlimited combination of training and/or rehabilitation movements, and/or treatment geometries may be established to exercise that area. Thus, extremity therapy apparatus 100 is configurable to allow the patient to perform multiple simultaneous movements at various angles for therapy of the forearm, wrist, thumb, and/or one or more joints of the digits.

Referring to FIG. 7, another side view of various support members in accordance with an exemplary embodiment is depicted. As discussed above, the planar shaped support member 10A shown in FIG. 1 may be replaced with one of the athletic, musical instrument, hand tool or incurvate support member 700, 705, 710, 715, 720, 725, 730, which allows the elbow, forearm, wrist, digits, and thumb to move through specific ranges of motion to reestablish movement patterns, strengthen weak motions, and or elongate tight structures. As discussed above, grip members 70 (FIG. 1) man be combined with the variously shaped support members 700, 705, 710, 715, 720, 725, 730 to assist in providing targeting specific motions of the forearm, wrist, thumb and/or any of the various joints of the digits.

In addition, grip members 70 can be configured to assist motions in opposite directions simultaneously. For example, pulling down on the metacarpal-phalangeal joints, while simultaneously opening or extending the proximal and distal inter-phalangeal joints. This is a simple example of the motions of the lumbrical muscles of the hand 2. Other configurations arrangements may be implemented if a fracture, and/or other tissue healing limitation requires that certain joint(s) remains stationary during therapy.

In an embodiment, the extremity therapy apparatus 100 may be configured for many applications, including but not limited to preventative care, rehabilitation, and neuromuscular training. For example, the extremity therapy apparatus 100 may be configured for training in the proper use of hand tools, athletic equipment grip simulation, and/or musical instrument grip simulation. The extremity therapy apparatus 100 may used to provide therapy for one or both extremities, either in a single unit or a pair of side by side units. In certain embodiments, the extremity therapy apparatus 100 may be configured to allow improved neuromuscular integration of movement patterns and/or training specificity of each hand simultaneously.

In an embodiment, the extremity therapy apparatus 100 may be configured to promote, inhibit or block an almost unlimited number of range of motions of an extremity 1 including, but not limited to: flexed elbow; extended elbow; forearm supination; forearm proration, wrist extension; wrist flexion; wrist ulnar deviation; wrist radial deviation; thumb abduction; thumb flexion, thumb extension, thumb opposition; digit flexion digit extension abduction; and/or digit adduction. Any of the described range of motions can be combined to simultaneously provide therapy to any part of the extremity 1.

The flexibility in configuration afforded by the extremity therapy apparatus 100, allows for more than one bias force or movement inhibition of an extremity 1 to occur simultaneously; generally as the patient attempts to go through a full or specified range of motion. In addition to all of the multiple angles of motion and or movement inhibition, the resistance can be varied. This allows specific amounts of strength requirements on different motions, joints, and digits. Some movements, as discussed above, may have different amounts of tension applied, at various angles, simultaneously.

The various exemplary inventive embodiments described herein are intended to be merely illustrative of the principles underlying the inventive concept. It is therefore contemplated that various modifications of the disclosed embodiments will, without departing from the inventive spirit and scope, be apparent to persons of ordinary skill in the art. They are not intended to limit the inventive embodiments to any precise form described. In particular, it is contemplated that the lift and related components may be constructed from any suitable material. No specific limitation is intended to a particular construction material, order or sequence described. Other variations and inventive embodiments are possible in light of above teachings, and it is not intended that this Detailed Description limit the inventive scope, but rather by the Claims following herein.

What is claimed:

1. An extremity therapy apparatus comprising:

a base member;

a column member coupled perpendicularly to about one end of the base member;

the column member configured to axially maintain a longitudinal member in a parallel spaced relationship with the base member;

the longitudinal member configured to maintain at least three arcuate members in a common vertical axis with the base member;

each of the at least three arcuate members being radially repositionable about the common vertical axis and configured to maintain two or more radial elements in a suitable geometry with an extremity for performing the extremity therapy, wherein the two or more radial elements are configured to simultaneously couple the extremity with at least two or more separate arcuate members in an angular alignment which specifically targets movement of a particular joint, muscle, bone or tendon of the extremity.

2. The apparatus of claim 1 further comprising a support member configured to maintain the extremity in the suitable geometry for performing extremity therapy when the extremity is rested directly upon a surface of the support member.

3. The apparatus of claim 2 wherein the base member is configured to repositionably maintain the support member.

4. The apparatus of claim 1 wherein the at least two or more radial elements which when simultaneously coupled with the at least two or more separate arcuate members and with the extremity is configured to provide a bias force in opposition to movement of a joint, muscle, bone or tendon associated with the extremity.

5. The apparatus of claim 1 wherein at least one radial element which when coupled with an arcuate member and with the extremity is configured to block movement of the targeted joint, muscle, bone or tendon associated with the extremity.

6. The extremity therapy apparatus of claim 1 wherein the angular alignment is approximately at a perpendicular angle to the targeted joint, muscle, bone or tendon of the extremity.

7. The extremity therapy apparatus of claim 2 wherein the support member is configured as one of an ovoid shaped platform, a planar shaped platform and an incurvate shaped platform.

8. The extremity therapy apparatus of claim 2 wherein the support member comprises a platform configured to support the extremity at angles relative to a horizontal plane.

9. The extremity therapy apparatus of claim 2 further comprising a pivoting joint coupled to the support member for repositionably maintaining the extremity at the suitable geometry for performing the extremity therapy.

10. The extremity therapy apparatus of claim 2 wherein the support member is configured as an object that is grasped or held by one or more extremities.

11. The extremity therapy apparatus of claim 10 wherein the object is selected from the group consisting of an athletic object, a musical object and a hand tool object.

12. The extremity therapy apparatus of claim 7 wherein the support member includes a plurality of apertures in which at least a portion of the apertures are configured to receive a grip member.

13. An extremity therapy apparatus comprising:

a base member configured to repositionably maintain a multi-axis adjustable support assembly;

the multi-axis adjustable support assembly being directly engaged with the base member including a replaceable support element coupled to a multi-axis joint;

a column member coupled perpendicularly to the base member; the column member configured to axially maintain a longitudinal member in a parallel spaced relationship with the base member;

the longitudinal member configured to maintain at least three arcuate members in a common vertical axis with the base member;

each of the at least three arcuate members being radially repositionable about the common vertical axis and configured to maintain two or more radial elements in a suitable geometry with an extremity for performing the extremity therapy;

wherein the two or more radial elements are configured to simultaneously couple the extremity with at least two separate arcuate members in an angular alignment which specifically targets movement of a particular joint, muscle, bone or tendon of the extremity.

14. The extremity therapy apparatus of claim 13 wherein the replaceable support element is replaceable by one of a planar shaped platform, an ovoid shaped platform and an incurvate shaped platform.

15. The extremity apparatus of claim 13 wherein the two or more radial elements which when simultaneously coupled with at least the two separate arcuate members and with the extremity is configured to provide a bias force in opposition to movement of a joint, muscle, bone or tendon associated with the extremity.

16. The extremity therapy apparatus of claim 13 wherein the replaceable support element is replaceable by an object that is grasped or held by one or more extremities.

17. The extremity therapy apparatus of claim 16 wherein the object is selected from the group consisting of an athletic object, a musical object and a hand tool object.

18. The extremity therapy apparatus of claim 13 further comprising at least two connectors for directly connecting the two or more radial elements with at least the two separate arcuate members.

19. An extremity therapy apparatus comprising:

a base member configured to repositionably maintain a multi-axis adjustable support assembly;

the multi-axis adjustable support assembly being directly engaged with the base member including a replaceable support element coupled to a multi-axis joint;

a column member coupled perpendicularly to the base member; the column member configured to axially maintain a longitudinal member in a parallel spaced relationship with the base member;

the longitudinal member configured to maintain at least three arcuate members in a common vertical axis with the base member;

each of the at least three arcuate members being radially repositionable about the common vertical axis and configured to maintain two or more radial elements in a suitable geometry with an extremity for performing the extremity therapy;

wherein the two or more radial elements are configured to simultaneously couple a single digit of the extremity with at least two separate arcuate members in an angular alignment which specifically targets movement of a particular joint, muscle, bone or tendon of the single digit.

20. The extremity therapy apparatus of claim 19 wherein the longitudinal member is further configured to concentrically maintain the arcuate members in a common plane with the column member which reduces the cross section of the extremity therapy apparatus for storage.

* * * * *